US005954018A

United States Patent [19]

Joshi

[11] Patent Number: 5,954,018

[45] Date of Patent: Sep. 21, 1999

[54] MODE SELECTIVE INTERNAL COMBUSTION ENGINE

[76] Inventor: Vasant Mukund Joshi, A-501 Neelkanth Complex, Sahar Road, Bombay 400 099, India

[21] Appl. No.: 08/853,027

[22] Filed: May 8, 1997

[51] Int. Cl.[6] ..... F01L 1/00

[52] U.S. Cl. ..... 123/90.16; 123/90.21; 123/90.26; 123/198 F

[58] Field of Search ..... 123/198 F, 90.15, 123/90.16, 90.1, 90.2, 90.21, 90.39, 90.44, 90.26

[56] References Cited

U.S. PATENT DOCUMENTS

| | | | |
|---|---|---|---|
| 3,913,548 | 10/1975 | Wilson | 123/90.15 |
| 4,151,817 | 5/1979 | Mueller | 123/90.16 |
| 4,382,428 | 5/1983 | Tourtelot, Jr. | 123/90.16 |
| 4,469,061 | 9/1984 | Ajiki et al. | 123/90.16 |
| 4,572,118 | 2/1986 | Baguena | 123/90.16 |
| 4,648,362 | 3/1987 | Kastlunger | 123/182.1 |
| 4,964,374 | 10/1990 | Joshi | 123/198 F |
| 5,207,193 | 5/1993 | Sugimoto et al. | 123/90.27 |
| 5,537,963 | 7/1996 | Hasebe et al. | 123/90.16 |
| 5,592,907 | 1/1997 | Hasabe et al. | 123/90.16 |
| 5,622,145 | 4/1997 | Hara | 123/90.16 |
| 5,701,857 | 12/1997 | Hara | 123/90.16 |

FOREIGN PATENT DOCUMENTS

| | | | |
|---|---|---|---|
| 0216647 | 7/1986 | European Pat. Off. | F01L 13/00 |
| 0235981 | 2/1987 | European Pat. Off. | F01L 13/00 |
| 493.221 | 4/1919 | France | F01L 13/00 |

*Primary Examiner*—Henry C. Yuen
*Assistant Examiner*—Hai Huynh
*Attorney, Agent, or Firm*—Ladas & Parry

[57] ABSTRACT

A cylinder of a mode selective internal combustion engine is operable in two modes, including one active mode with conventional operations of cylinder valves and another passive mode with continuously closed or open engine valves. By creating ideal combustion conditions in all active cylinder cycles throughout a range of loads, the engine has improved brake thermal efficiency and produces less effluents. A mode camshaft turned at or close to an integer fractional speed of the primary camshaft synchronizes change of mode of each cylinder valve within its inactive phase in the working cycle, and further provides for change of mode of suction and exhaust valves in the same cycle.

16 Claims, 8 Drawing Sheets

FIG. 1B
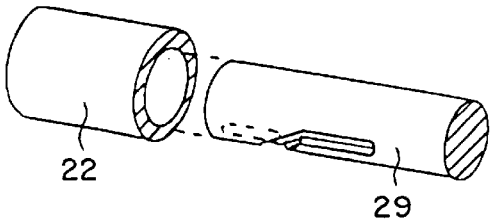
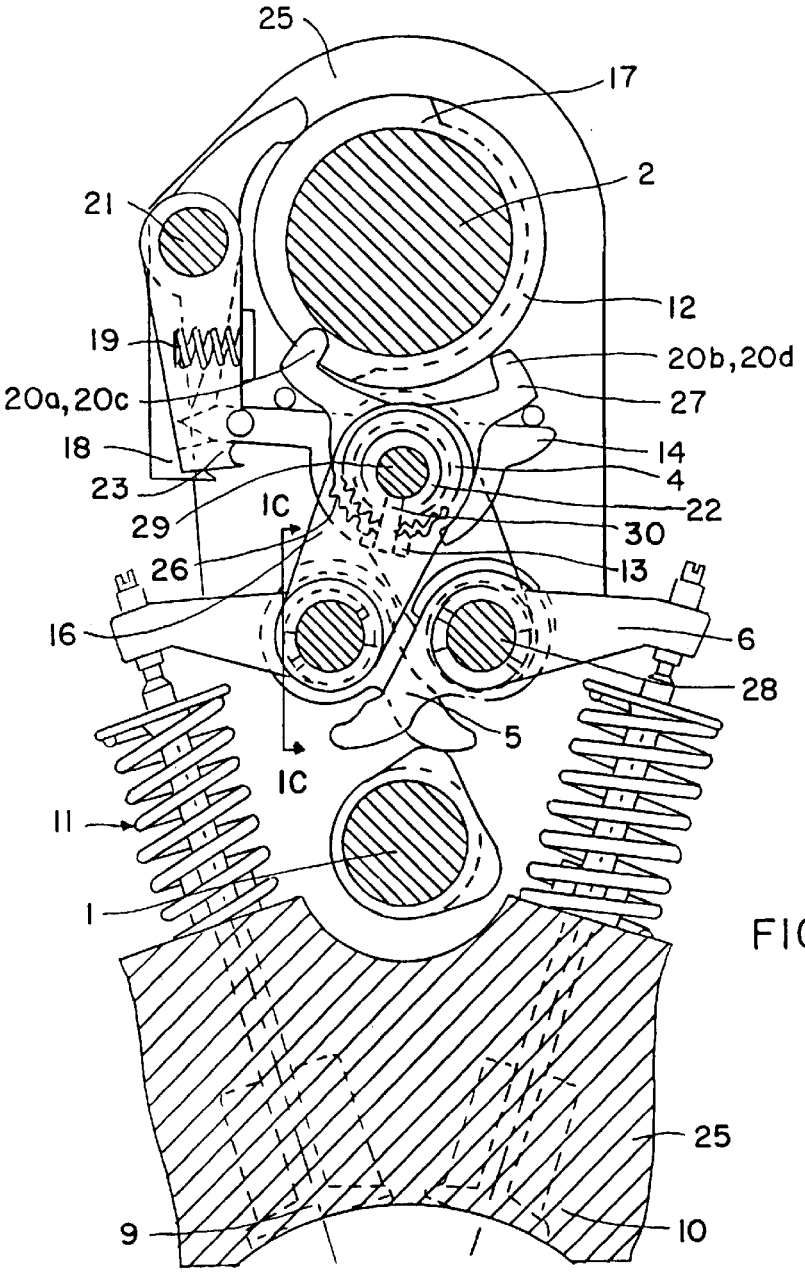
FIG. 1A
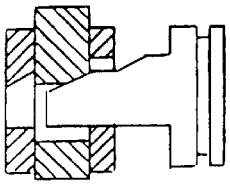
FIG. 1C

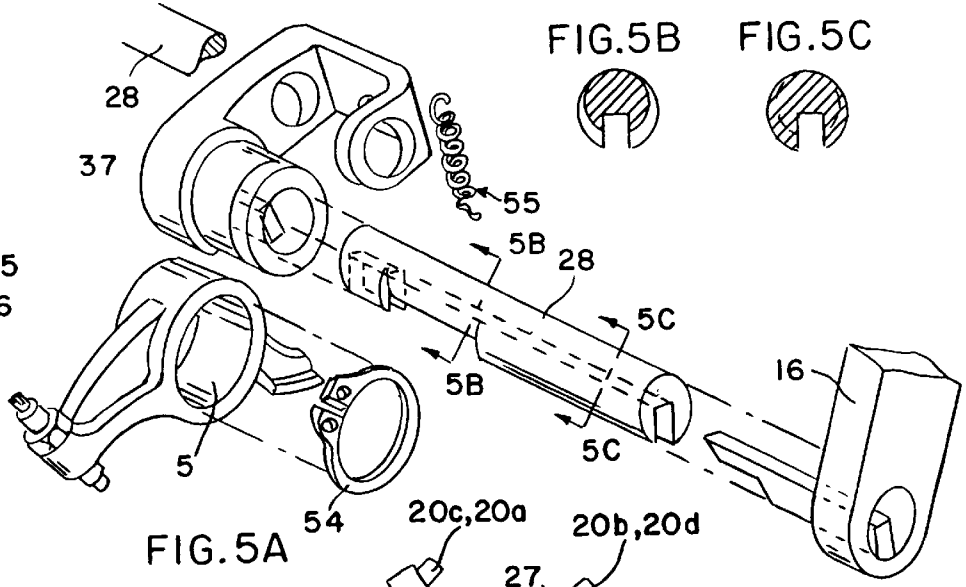
FIG.5A
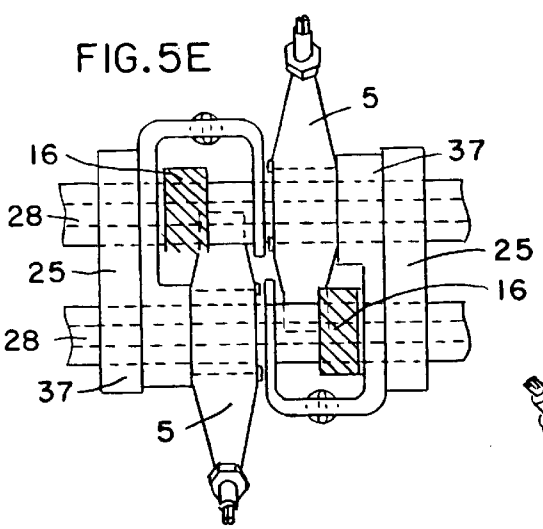
FIG.5E
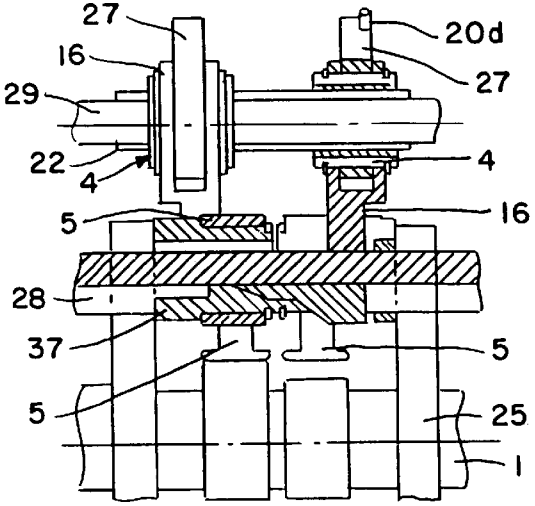
FIG.5F
FIG.5B
FIG.5C
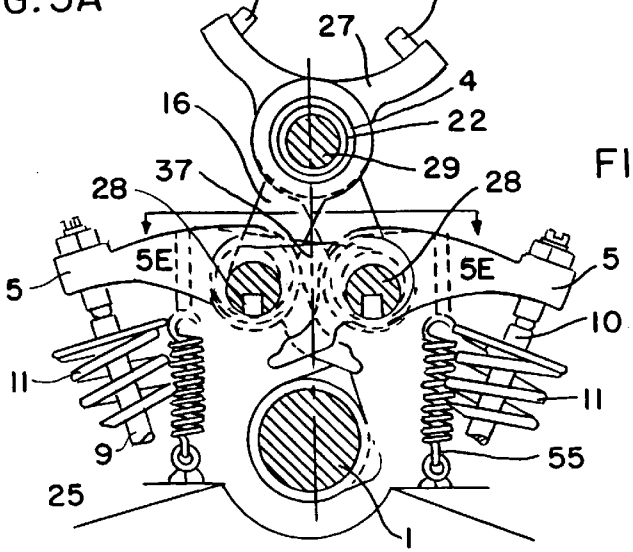
FIG.5D

MODE SELECTIVE INTERNAL COMBUSTION ENGINE

BACKGROUND OF THE INVENTION

This invention relates to mode selective internal combustion engines providing multiple cyclic operating modes for cylinder components such as valves or pistons. U.S. Pat. No. 4,964,374 and CIP application Ser. No. 08/623,466 describe mechanisms for regulating power output of engines by alternately working cylinders between active and passive modes. Depending on load conditions, mode selective engines maintain optimum combustion conditions for a controlled number of cylinder cycles in the active mode, and eliminate combustion in remaining cylinder cycles in the passive mode. This improves the overall indicated efficiency of engines and reduces emissions of NOx and other oxides.

A large portion of indicated power of conventional engines is consumed by mechanical losses. Mode selective engines have lesser internal losses within cylinders in the passive mode because of elimination of valve movements, gas exchange and compression. Engines built as per U.S. Pat. No. 4,964,374 have no piston movements in the passive mode and thereby eliminate friction between pistons and cylinders in such passive modes. In other cases, there is reduced friction between each piston assembly and cylinder in the passive mode as unexpanded piston rings exert lesser pressure against the cylinder and unloaded pistons exert lesser pressures on gudgeon pins and the crankshaft.

With higher indicated efficiency and reduced mechanical losses, mode selective engines are brake thermally more efficient than conventional engines, particularly when passive mode cylinder operations become more frequent with lighter loads. Mode selective engines are most suited for automotive applications where engines often transmit negligible, nil or even negative power to the crankshaft over long periods, allowing simultaneous passive mode operations of all cylinders without intake of fuel and production of effluents.

Engines need good reserve power to accelerate faster even while they operate with lesser loads. The reserve power of mode selective engines is not compromised by their operations in the passive mode, as all cylinders retain the potential of delivering peak power within a few cycles by switching to the active mode. In practice, mode selective engines are operable at relatively high idling and running speeds without sacrificing fuel economy, which gives them greater reserve power than conventional engines in identical load situations.

Unfavorably, known mode selective engines are complex, large and comprise more components than conventional engines. Elaborate timing and powering mechanisms are employed for changing modes of different cylinder components.

SUMMARY OF THE INVENTION

The present invention offers improved and simpler embodiments of mode selective engines, using simpler, mechanical, faster responding and reliable timing mechanisms allowing independent mode changes of each cylinder.

Several embodiments of the present invention are now described and illustrated. Referring to the figures, the designations of various components are as follows: camshaft 1, mode camshaft 2, bearing 3, linear bearing 4, rocker 5, rocking lever 6, rocker lock 7, gears 8, suction valve 9, exhaust valve 10, valve spring 11, shifter 12, mode bush 13, toggle lever 14, accelerator 15, follower 16, locking cam 17, locking lever 18, locking spring 19, follower pins 20(*a–d*), pivots 21 and 22, locating lever 23, anti-rotation peg 24, engine body 25, mode spring 26, follower bracket 27, rocker pivot 28, activating camshaft 29, groove follower pin 30, rocker retainer 31, synchronizing plate 33, hydraulic clutch 34, inner ring 35, floating rocker pivot 37, linear bearings 38 and 39, dowel pin 40, orientation pin 41, sliding guide slot 42, face cam 43, spring 44, mode change enabling rod 45, braking rod 48, brake rocker lock 49, outer ring 50, spring loaded pawl 51, activating shifter groove 52, passivating shifter groove 53, circlips 54, and spring 55.

The names given to components in this specification are suggestive of their function, and are not definitive about their construction or shape.

BRIEF DESCRIPTION OF THE DRAWINGS

FIGS. 1 to 4 illustrate a first preferred embodiment of the invention with the passive mode characterized by closed suction and exhaust valves.

FIG. 1 is a schematic cross-sectional view of components in the passive operating mode in the camshaft position for the suction stroke.

FIG. 2 shows the same components shown in FIG. 1, with the components in the active operating mode for the same camshaft position.

FIG. 3 is an exploded view showing all components relating to one cylinder of the first embodiment.

FIG. 4 is a timing diagram showing cyclic operations of cylinder components. Table I describes plots 1 to 9 referring to the first embodiment. Plot 29 is an alternative to plot 9 for a variation of the first embodiment in which the exhaust valve is kept open in the passive mode. Plots 13 to 19 are equivalents of plots 3 to 9 for the third embodiment of the invention.

FIG. 5 shows a second embodiment of the invention with provisions for lifting rockers on their pivots in the passive mode.

DETAILED DESCRIPTION OF THE INVENTION

Figure 2A:
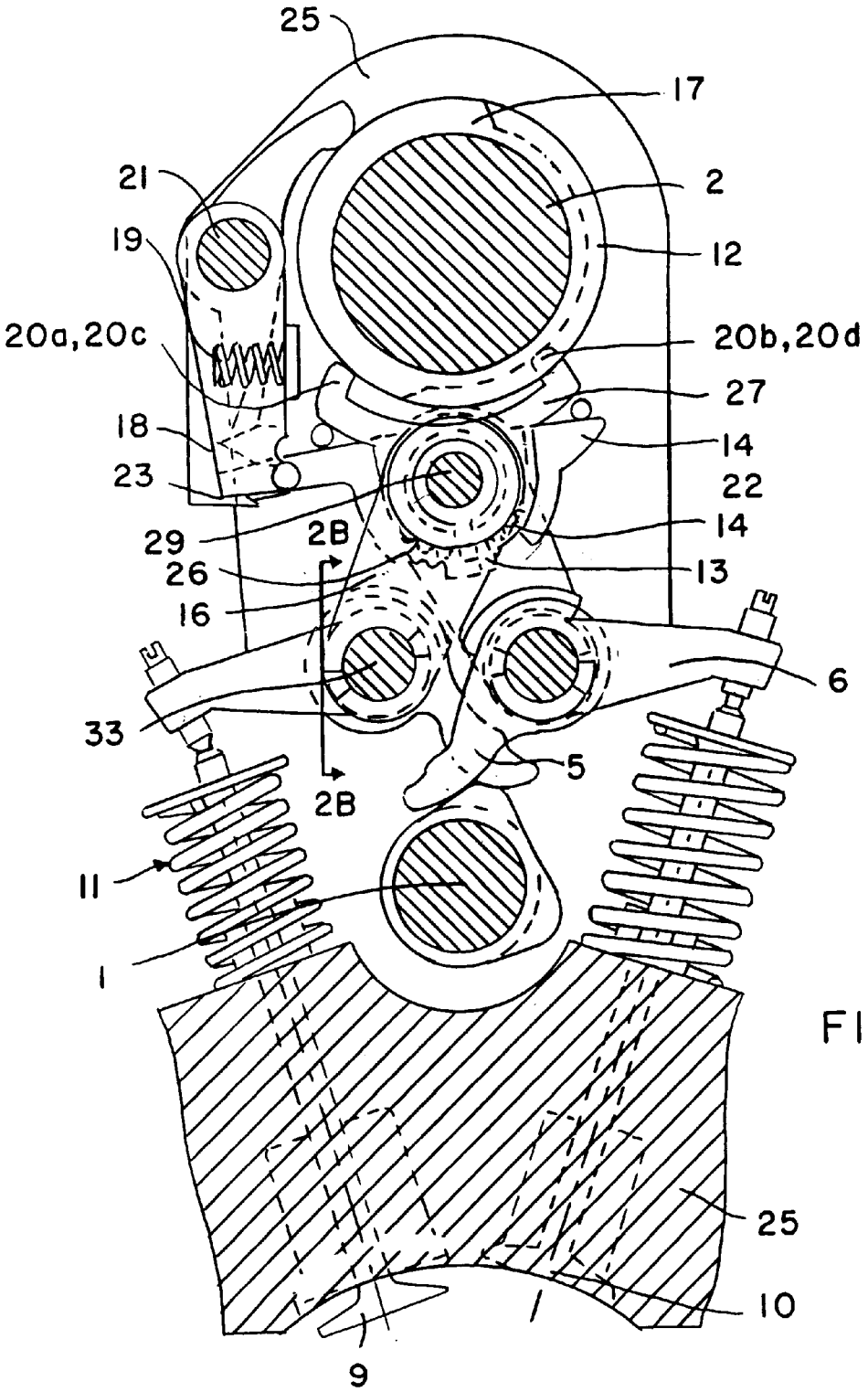

Description of the First Embodiment of the Invention

FIG. 1 shows the first preferred embodiment of the invention, wherein the passive mode is characterized by closed cylinder valves. Each rocker assembly consists of three components arranged around the rocker pivot 28: i) rocking lever 6 connecting to the valve 9, 10, ii) rocker 5 incident upon the camshaft 1, and iii) rocker lock 7 with projecting wedges of variable thickness slidable between keyways of the rocker 5 and rocking lever 6. Rocker retainer 31 maintains axial position of the rocking lever 6. The extended cylinder head of engine body 25 supports solid pivot 21 and tubular pivot 22. Anti-rotation peg 24 on pivot 22 allows axial movement to a slidable activating camshaft 29. Mode camshaft 2 is rotated at a fourth of camshaft 1 speed within bearings 3 by gears 8. Besides moving the activating camshaft 29, accelerator 15 also operates the throttle of the carburetor (not shown).

For and over each cylinder, the mode camshaft 2 bears a locking cam 17 and two shifters 12. The locking cam 17 has a profile consisting of opposite arc segments of low and high radii extending over 180 degrees and 130 degrees of the locking cam's circumference respectively, smoothly joined by helical segments of 25 degrees each on either side.

Each shifter 12 has three interconnected grooves over the cylindrical surface of each shifter 12. The first groove is circular and bifurcates the cylindrical surface. The second groove begins at the end of the cylindrical surface towards the locking cam and runs parallel to the circular groove for 300 degrees, later becomes helical for 60 degrees and merges in the first groove. The third groove begins with the same initial distance on the other end of the cylindrical surface 90 degrees behind the second groove. It too runs parallel to the circular groove for 300 degrees before becoming helical for 60 degrees and merging in the first groove.

The groove profile for suction valve shifter 12 is a mirror copy of the groove profile for the exhaust valve shifter 12, except that the two shifters are radially staggered on the mode camshaft 2 with the suction valve shifter 12 leading the exhaust valve shifter 12 by 67.5 degrees.

Locking lever 18 and locating lever 23 both pivot around pivot 21. The upper arm of locking lever 18 is operable by the locking cam 17. On the inner edges of lower arms of the locking lever 18 and the locating lever 23, there are two adjacent triangular and half round notches, respectively, in identical radial positions. The locking lever 18 is pushed to its locked position by the high radius of locking cam 17, while locking spring 19 pushes the locking lever out of this position with lesser radii of the locking cam 17. The other end of locking spring 19 pushes the locating lever 23 against pin 40 in toggle lever 14, offering a continuous holding torque for the toggle lever 14.

Follower 16 is slidably supported around pivot 22 over linear bearing 4. Pivoting over linear bearing 4, between forked ends of the follower, is a follower bracket 27 having two follower pins 20 over its top diagonal positions rising towards the shifter axis. The axial spacing between the follower pins 20 equals the initial distance of either the second or third groove from the first groove on the shifter 12. Around the mode camshaft, follower pins 20*a* and 20*c* belonging to the suction and exhaust follower bracket respectively, lead over their counterparts 20*b* and 20*d*, by 90 degrees. Pins 20*a* and 20*c* are always in the same radial positions and both become incident against the second grooves of their respective shifters 12.

Pivot 22 rotatably supports mode bush 13 supporting toggle lever 14. Crossbars forming part of toggle lever 14 lie under both follower brackets 27 on both sides and cause rotary movements of both followers 16 with toggle lever 14. The crossbars do not restrict independent axial movement of any follower 16 over pivot 22 in any rotary position. Groove follower pin 30 at bottom of mode bush 13 passes through a transverse groove in pivot 22 into a mode groove in the activating camshaft 29. The mode groove has staggered linear end segments joined by a helical segment. Mode springs 26 connect the mode bush 13 and the toggle lever 14. In the passive mode, follower pins 20*a* and 20*c* engage with the shifters 12 and the toggle lever 14 is located in the upper notches of locking lever 18 and locating lever 23. In the active mode, follower pins 20*b* and 20*d* engage with the shifters 12 and the toggle lever 14 is located in the lower notches.

The axial sliding of activating camshaft 29 within pivot 22 causes rotation of mode bush 13 as groove follower pin 30 passes through the helical segment of the mode groove. Rotation of mode bush 13 results in compression of a mode spring 26 causing a rotary torque to be exerted on toggle lever 14. The locking lever 18 in the locked position detains the toggle lever 14. In the unlocked position of the locking lever 18, the locating lever 23 detains the toggle lever 14 until the torque exerted by compressed mode spring 26 of the retention torque of locking spring 19. When the former torque exceeds the latter torque, the toggle lever 14 turns with the follower brackets 27 causing interchange of the follower pins 20 engaging with the shifters 12.

The lower end of each follower 16 envelops rocker pivot 28 with part of the follower 16 engaging with a groove of the rocker lock 7 supported over the rocker pivot 28.

With this engagement, the rocker lock 7 follows the axial positions of the follower 16, and in each of these axial positions the rocker lock 7 wedges with variable thickness between the keyways of the rocker 5 and rocking lever 6. In the active mode axial position, the wedge thickness within the keyways is greater and the combined geometry of the rocker components resembles a conventional rocker producing active valve operations with the camshaft 1. In the passive mode axial position, the wedge thickness within the keyways is smaller permitting the rocker 5 to lift completely by the camshaft 1 and yet relieve the rocking lever 6 and the valve 9, 10 of any movement.

Working of the First Embodiment of the Invention

Figure 4:
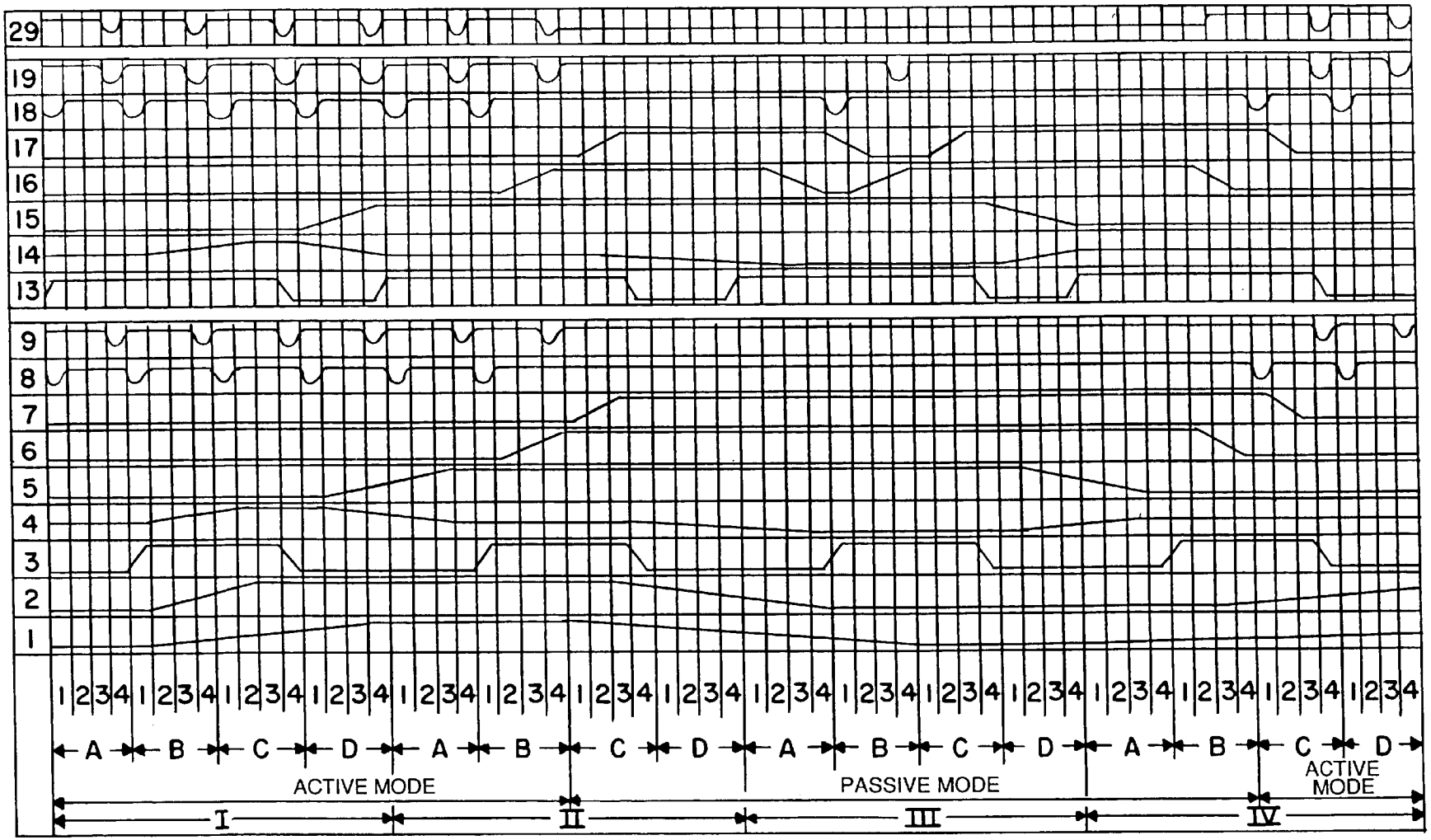

The working of the first embodiment is illustrated by plots 1 to 9 of FIG. 4. Table I below defines each plot referring to positions of various cylinder components passing through 16 successive camshaft cycles I-A to IV-D, in 4 mode camshaft cycles I–IV, spanning both stable modes and both transitory phases. Sub-divisions 1–4 denote cylinder strokes within each camshaft cycle.

TABLE I

| Plot Parameter | Low level of plot indicates | High level of plot indicates |
|---|---|---|
| 1) Accelerator 15 position. | pressed | released |
| 2) Mode bush 13 position. | counter-clockwise | clockwise |
| 3) Locking lever 18 position. | unlocked | locked |
| 4) Compression in mode springs 26. | right spring compressed | left spring compressed |
| 5) Toggle lever 14, suction and exhaust follower 16 rotary position. | counter-clockwise | clockwise |
| 6) Suction follower 16 axial position. | active mode (inwards) | passive mode (outwards) |
| 7) Exhaust follower 16 axial position. | active mode (inwards) | passive mode (outwards) |
| 8) Suction valve position 9. | valve open | valve closed |
| 9) Exhaust valve position 10. | valve open | valve closed |

Referring to the FIG. 4, I-A, at the beginning of the plots shown, the engine is fully loaded, and the cylinder whose component operations are plotted in FIG. 4 operates in the active mode. At this stage, the accelerator pedal is fully depressed. The mode bush 13, toggle lever 14 and followers 16 are all in extreme anti-clockwise positions and both mode springs 26 are uncompressed.

In the active mode, toggle lever 14 is aligned with the lower notch of locking lever 18 and locating lever 23. Follower pins 20*b* and 20*d* run in the middle grooves of their respective shifters 12, drawing both followers inwards in their active mode axial positions. Rocker lock 7 wedges with maximum thickness within rocker 5 and rocking lever 6, and cylinder valves 9, 10 are operated with the camshaft 1 as in a conventional engine (refer to plots 8 and 9 of FIG. 4).

The locking cam 17 synchronizes change of modes with the working cycle of the cylinder by oscillating the locking lever 18 between locked and unlocked positions, with the latter positions coincident with the inactive camshaft 1 positions.

Limited axial movement of the activating camshaft by slight lifting of the accelerator 15 has no effect on mode bush 13 position as groove follower pin 30 remains within the straight segment of the mode groove of the activating camshaft 29. However, power output decreases by throttling. Increased lifting of the accelerator pedal turns the mode bush 13 clockwise as the groove follower pin 30 enters the helical section of the mode groove. However, the locating lever 23 continues to locate the toggle lever 14 in its lower slot and left mode spring 26 gets compressed.

When compression of left mode spring 26 exceeds the retention pressure of the locking spring 19 on the locating lever 23, it turns the toggle lever 14 clockwise in the unlocked positions of the locking lever 18, (see I-D-2 to II-A-3 in FIG. 4). The toggle lever 14 turns with the followers 16 causing withdrawal of follower pins 20*b* and 20*d* from the circular grooves of shifters 12 and engagement of follower pins 20*a* and 20*c* in the first segments of side grooves on their respective shifters 12 nearer to the locking cam 17.

At this point, the toggle lever is located in the upper notch of the locking lever 18. For 130 degrees of mode camshaft rotation, the locking lever 18 locks the toggle lever 14 by remaining over the high radius of locking cam 17, (see II-B-1 to II-C-4 in FIG. 4). For 60 degrees from this period, (i.e., from II-B-2 to II-B-4), follower pin 20*a* passes through the helical segment of its side groove. After a gap of 7.5 degrees, over a subsequent period of 60 degrees, (i.e., from II-C-1 to II-C-3), follower pin 20*c* passes through the helical segment of its side groove. The journeying of follower pins 20*a*, 20*c* through the helical segments causes followers 16 to move to their passive mode axial positions. Throughout the passive mode, follower pins 20*a* and 20*c* run in the circular grooves of their respective shifters.

In the passive mode axial position of followers 16 and rocker locks 7, the valves 9,10 are inoperable by rocking levers 6 even by fully lifted rockers 5, as seen in FIG. 1.

Over every 60 degrees of shiftable rotary positions of a shifter 12 in which any follower pin 20 passes through a helical segment, the camshaft 1 rotates by 240 degrees. Synchronization between rotations of mode camshaft 2 and camshaft 1 ensures that the corresponding cylinder valve 9,10 is always inoperative by the camshaft 1 over these periods (referring to FIG. 4):- II-B-2 to II-B-4 for the suction valve 9 and II-C-1 to II-C-3 for the exhaust valve 10. By staggering their respective shifters by an equivalent (270/4=) 67.5 mode camshaft degrees, the mode of the exhaust valve is changed 270 camshaft degrees after the suction valve 9.

Figure 2B:
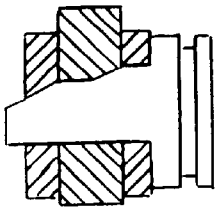

The cylinder reverts to active mode operations by pressing the accelerator pedal. With movement of the accelerator pedal, the activating camshaft 29 turns the mode bush 13 by its mode groove acting on the groove follower pin 30. This compresses the right mode spring II-C-3 to II-A-4 in FIG. 4, which turns the toggle lever 14 and followers 16 counter-clockwise, whenever the mode spring 26 pressure exceeds the retention pressure of the locking spring 19 and the locking lever 18 is unlocked, (see II-D-2 to IV-A-3 in FIG. 4). This moves the toggle lever 14 to the level of the lower notch of the locking lever 18. Follower pins 20*a* and 20*c* disengage from the shifters 12 and follower pins 20*b* and 20*d* engage with the side grooves of their respective shifters 12 away from the locking cam 17. In respective shiftable rotary positions of 60 degrees, (IV-B-2 to IV-B-4 for the suction valve 9 and IV-C-1 to IV-C-3 for the exhaust valve 10 in FIG. 4), follower pins 20 pass through the helical segments of the side grooves, dragging the followers 16 to their active positions. The rocker locks 7 turn to their active positions over the rockers 5 and active mode operations of the cylinder are resumed as seen in FIG. 2, (see Fig. IV-C-1 onwards).

The mode camshaft 2 turns once with every four camshaft 1 rotations. Each cylinder changes mode beginning from specific rotary positions of the mode camshaft 2 occurring in every fourth camshaft 1 cycle. In case of multiple cylinders, each cylinder can change its mode beginning from overlapped or staggered camshaft 1 cycles, depending on the relative placement of shifters 12 and locking cams 17 for the cylinder on the mode camshaft 2. To change modes within overlapping cylinder cycles, the radial staggering of the sets of shifters 12 and locking cams 17 for different cylinders on the mode camshaft 2 is by one fourth of the staggering of their respective valve cams on the camshaft 1. However, for smoother and quicker response from the engine, change in modes of different cylinders should begin from distinct non-overlapping camshaft 1 cycles. For this, the corresponding cams 17 on the mode camshaft 2 are staggered by a sum of: one fourth of the staggering of their respective valve cams on the camshaft 1, and 90/180/270 degrees corresponding to a further offset by 1/2/3 complete camshaft rotations.

In multi-cylinder engines, the power output from the engine can be controlled in steps if modes of different cylinders are changed in different axial positions of the activating camshaft 29. This is possible when mode grooves for different cylinders have staggered positions of their helical segments against corresponding groove follower pins 30.

Figures 3A, 3B, 3C:
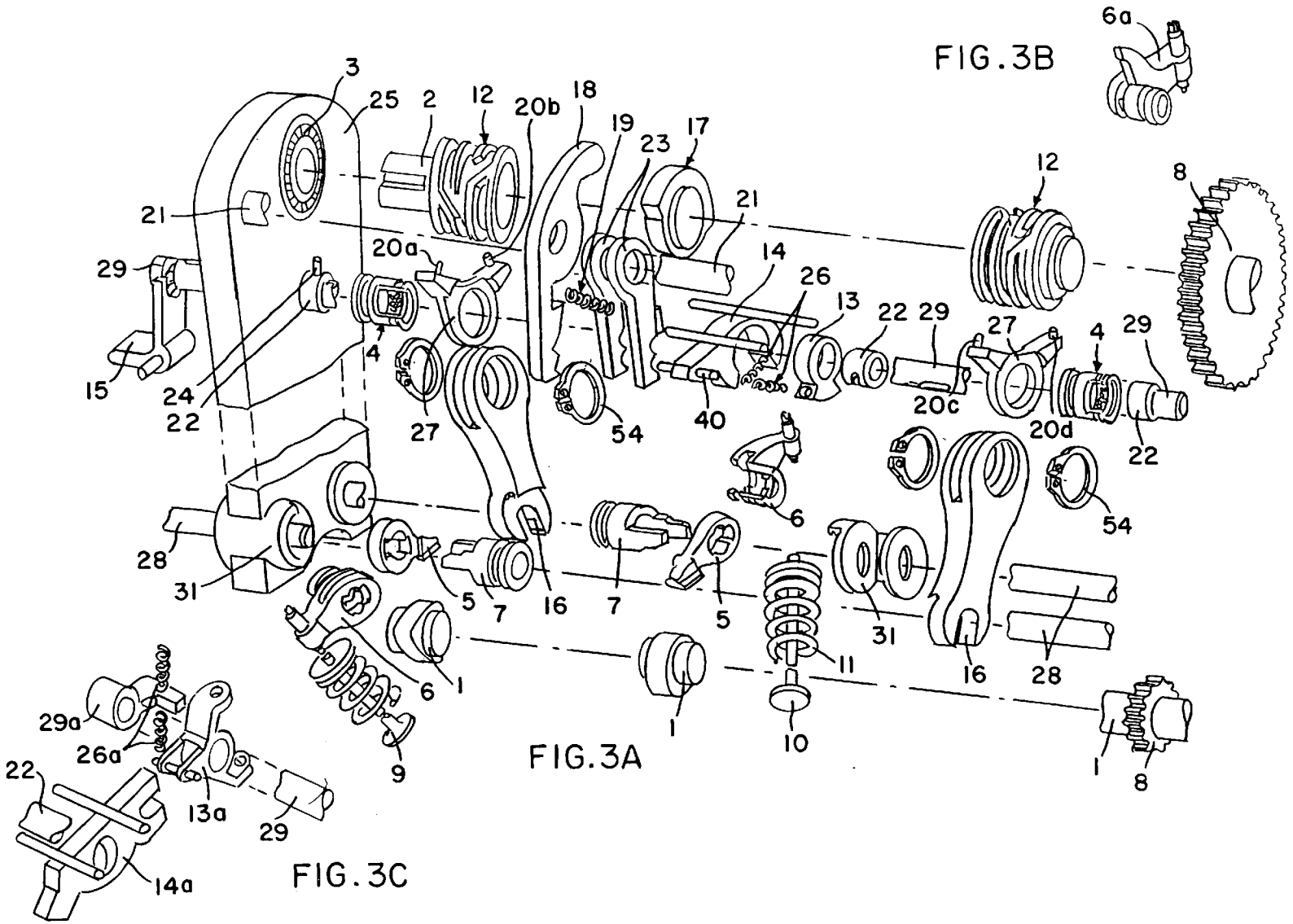

It is possible to derive all benefits of mode selective engines even by keeping the exhaust valve 10 open throughout the passive mode. This allows the cylinder to breathe from the exhaust manifold (not shown) and maintain a higher temperature for internal cylinder components. A design of the modified exhaust valve rocking lever 6*a* for enabling such operations, is shown in top right corner of FIG. 3. The suction valve follower 16, while moving to its passive mode position during the last active exhaust stroke (see in FIG. 4, II-B-4), gets behind the extended projection of the exhaust valve rocking lever 6*a* restricting its retraction at the end of the exhaust stroke. The exhaust valve 10 remains partly open as shown in plot 29 on FIG. 4. When changing back to the active mode, the latched exhaust valve rocking lever 7*a* is first released by the suction follower 16 in the last passive stroke as indicated at IV-B-2 in FIG. 4.

The mode camshaft could be driven at a different integer fraction of the camshaft speed, a range between ½ to ⅙ being practical. The faster speeds improve the engine response during mode changes. With slower speeds, the toggle lever 14 and follower brackets 27 get more time to act. The angular staggering of shifters 12 and locking cams 17 on the mode camshaft 2 is by the same fraction of the angular staggering of the respective cams on the camshaft 1.

In different embodiments, the activating camshaft 29 may be located differently. In an embodiment shown in bottom left corner of FIG. 3, the activating camshaft 29*a* is located outside and parallel to pivot 22 and its rotary positions depend upon the accelerator 15 position. Mode cam 13*a* is rotatably supported over the activating camshaft 29 and mode springs 26*a* connect it to the activating camshaft 29. The toggle lever 14*a* is directly supported on pivot 22 and its rotation is linked to the rotation of the mode cam 13*a* through a pin of the former entering slot of the latter. The toggle lever 14*a* turns with the mode cam 13*a* when torque by the mode spring 26*a* exceeds the retention torque of locking spring 19.

Second Embodiment of the Invention

A second embodiment of the invention shown in FIG. 5 has unitary rockers 5 raised or lowered in the passive or active modes, respectively.

Each of rockers 5 in this embodiment is rotatably held over the main body of floating rocker pivot 37 by circlip 54. Each floating rocker pivot 37 is supported over one rocker pivot 28 while its main body is raised or lowered about the other rocker pivot 28. The latter has arc shaped undercuts in axial positions of the floating rocker pivots 37 allowing limited near vertical movement of floating rocker pivots. Each rocker pivot 28 has a keyway on its bottom side throughout the length. Within the bore of the main body of the floating rocker pivot 37, it has an inward projecting key with a chamfered face in line with the keyway of the rocker pivot 28.

The lower end of a follower 16 of this embodiment encircles the rocker pivot 28 and has a wedge with varying cross-sections, lying within the keyway of the rocker pivot 28 and entering inside the main body of the floating rocker pivot 37 to meet the chamfered face of the inward projecting key of the floating rocker pivot 37. In the active mode axial position of the follower 16, part of the taper wedge enters between the rocker pivot 28 and key of the floating rocker pivot 37 pushing the latter to its lowest position to cause normal operations of the valve 9, 10 with the camshaft 1. In the passive mode axial position of the follower 16, the taper wedge completely withdraws from between the rocker pivot 28 and floating rocker pivot 37 allowing the latter with rocker 5 to be lifted by spring 55 to a level ceasing valve movements by the camshaft 1.

Third Embodiment of the Invention

Figure 6C:
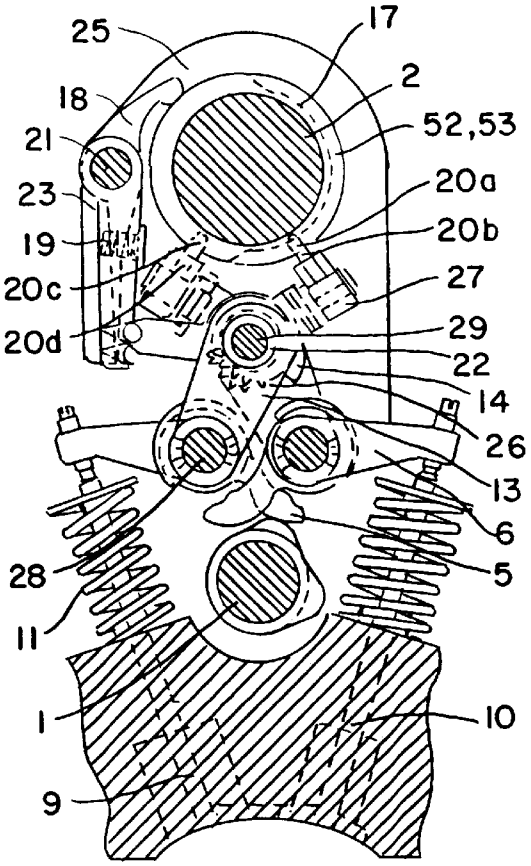
FIG. 6 shows a third embodiment providing for intermittently active operations for cylinders otherwise in the passive mode.
Figure 6B:
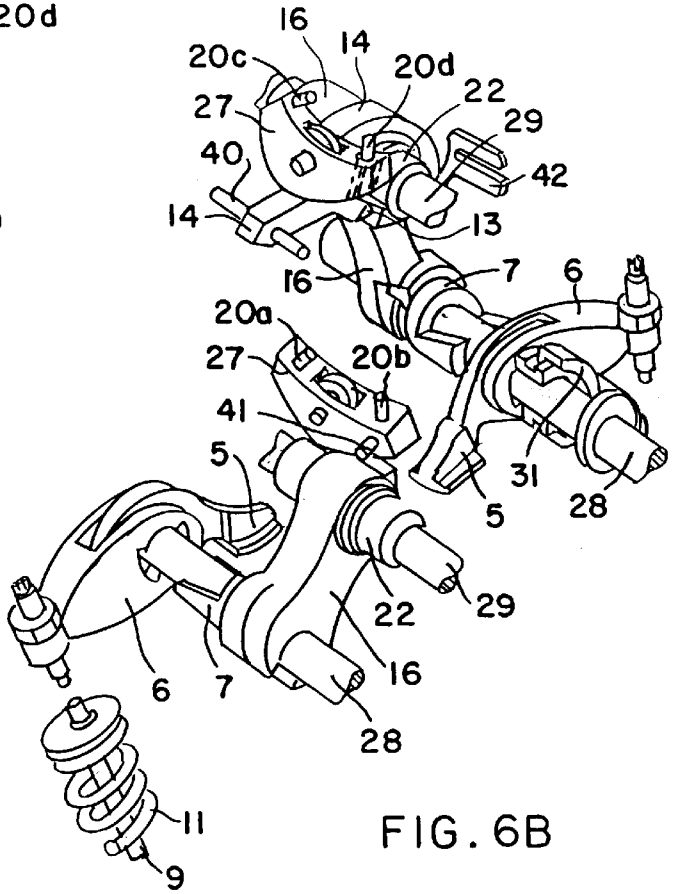
Figure 6A:
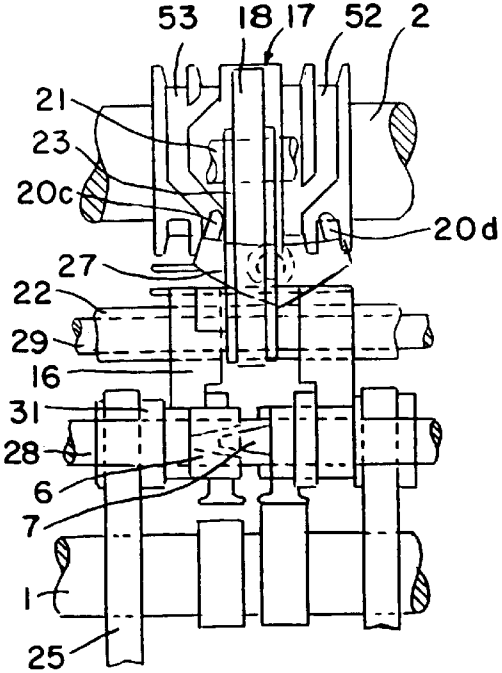

A third embodiment of the invention, shown in FIG. 6, provides intermittent active operations for cylinders in every fourth cycle in the passive mode, to generate fractional power output from every cylinder and to keep internals warm. In this embodiment, the follower brackets 27 are supported on pivots 22 which are tangential to the mode camshaft 2 axis and both suction and exhaust followers 16 are moved by activating shifter groove 52 and passivating shifter groove 53, for shifting to active or passive axial positions, respectively.

The activating shifter groove 52 has three segments. In the first segment, the groove 52 is partially circular for 300 degrees. In the second segment of 60 degrees, the groove 52 helically moves closer to the locking cam 17. In the third segment, the groove 52 is circular and closes with itself.

The passivating shifter groove 53 has four segments. The first two segments are mirror images of the first two segments of the activating groove 52 in identical radial positions of the shifter 12. The third segment is partially circular for 210 degrees. At the end of the fourth helical segment of 60 degrees, the passivating groove 53 merges with its first segment at a radial position 30 degrees prior to the beginning of the second segment.

Both follower brackets 27 are supported on pivots extending from the followers 16 on opposite sides above the centre of the cylinder. The follower pins 20 of the follower brackets 27 point towards the mode camshaft 2 axis with an angle of 33.75 degrees on either side of the vertical centre plane of the engine. The distance between follower pins 20*a*,20*b*; 20*c*,20*d* of a follower bracket 27 is equal to the distance between the first segment of the activating groove 52 and the third segment of the passivating groove 53, or between the first segment of the passivating groove 53 and the third segment of the activating groove 52. Each follower bracket 27 is moved by an orientation pin 41 parallel to its pivot and guided by the open slot 42 on a side of the toggle lever 14. Rotation of the toggle lever 14 to the passive mode position causes follower pins 20*a* and 20*b* for the suction and exhaust valves 9, 10 respectively to enter into the passivating shifter groove 53, and follower pins 20*c* and 20*d* to retract from the activating shifter groove 52. Toggle lever 14 rotation to the active mode position reverses this operation. Engagement always occurs with the follower pins 20 entering the first segments of the grooves. After engagement with either of the activating or passivating grooves 52, 53, the movement of suction follower 16 precedes the movement of the exhaust follower 16 by 67.5 degrees, as pin 20*a* or 20*b* leads over pin 20*c* or 20*d* respectively, in the direction of mode camshaft 2 rotation. Orientation pins 41 remain engaged in the open slots 42 of the toggle lever 14 in all axial positions of the followers.

Plots 13 to 19 of FIG. 4 show the differences in component operations compared with corresponding plots 3 to 9 for the first embodiment of the present invention; (see Table I). With introduction of an additional helical fourth segment of 60 degrees for the passivating groove 53 with a spacing of 30 degrees between the two helical segments on the passivating groove 53, the total shiftable rotary positions of the mode camshaft 2 extend to 227.5 degrees, requiring the locking cam 17 to have high radius over this range, (refer plot 13). Helical segments of 25 degrees are required before and after the high radius of the locking cam 17, which leaves 360−277.5=87.5 degrees of mode camshaft 2 rotation as switchable rotary positions in this embodiment to have a uniform low radius. Rotation of the toggle lever 14 is restricted to occur within this period, (see plot 15).

Fourth Embodiment of The Invention

Figure 7C:
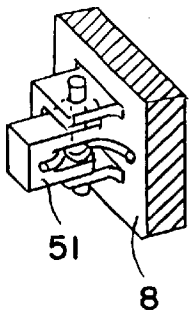
FIG. 7 shows a schematic part-sectional plan and end view of a fourth embodiment in which the mode camshaft rotates only while changing modes.
Figure 7B:
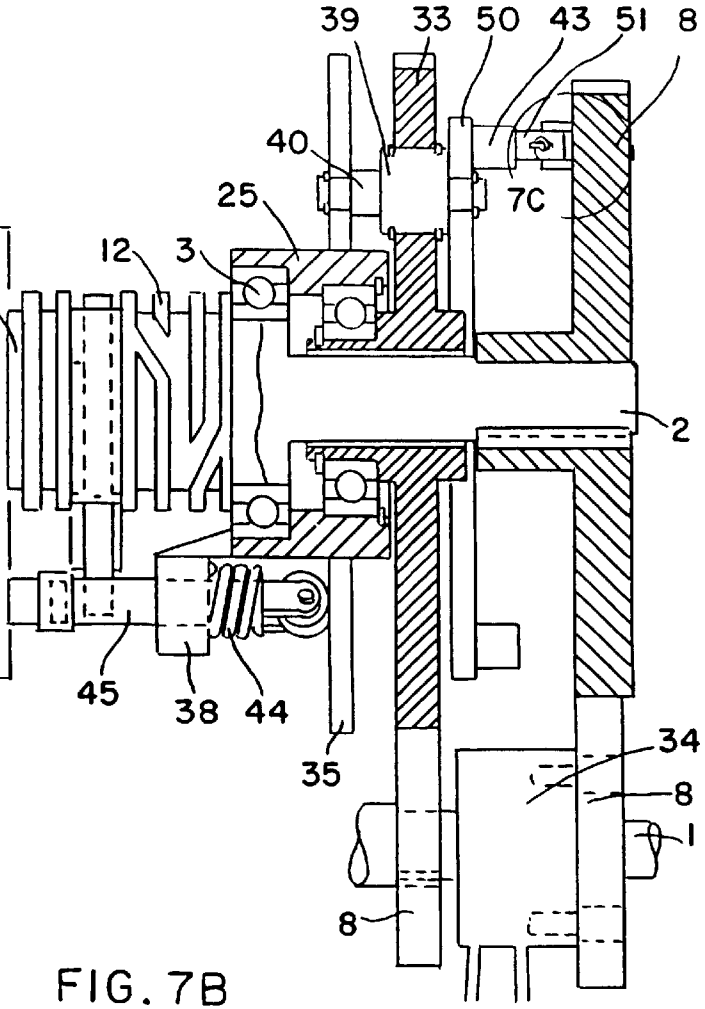
Figure 7A:
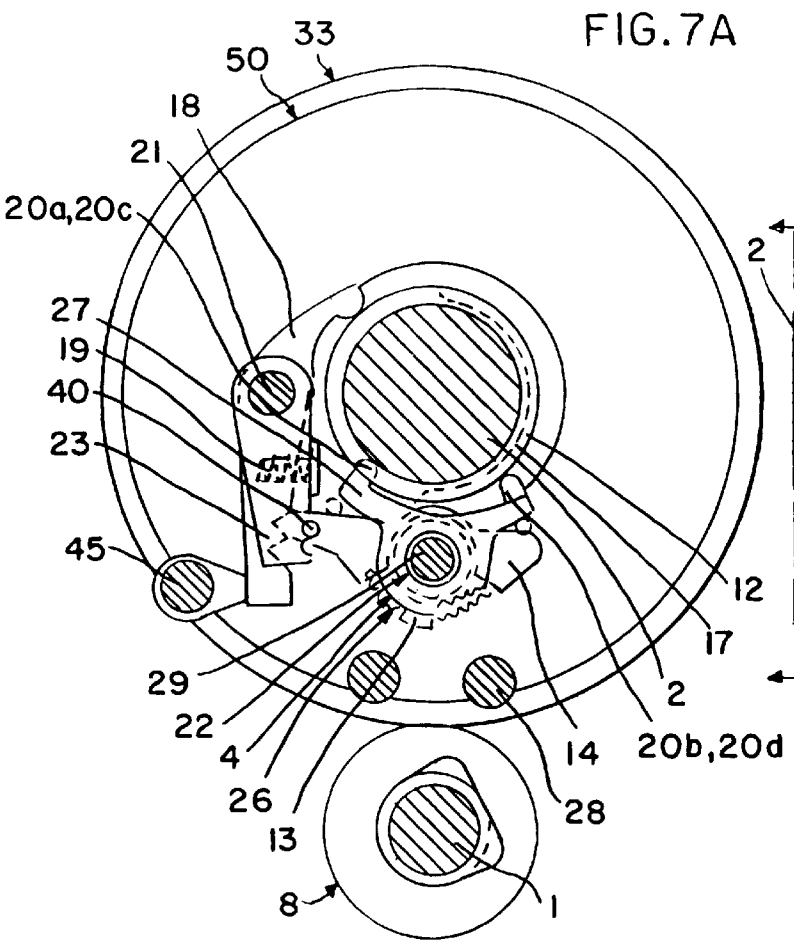

The first three embodiments of the present invention described above require the mode camshaft 2 to be rotated at an integer fraction of the camshaft 1 speed. Continuous rotation of mode camshaft 2 and continuous oscillations of the locking levers 18, however, add to the engine's losses besides causing wear of follower pins 20. A fourth embodiment of the invention illustrated in FIG. 7 does not add to these losses by allowing intermittent mode camshaft 2 rotation while changing modes. The mode camshaft 2 is rotated at a distinctly different speed than an integer fraction of the camshaft 1 speed.

For intermittent rotation, mode camshaft 29 is driven through a hydraulic clutch 34 which is energized by moving the activating camshaft to its middle positions. Some of gears 8 rotate the mode camshaft 8 at 25.5% of camshaft 1 speed when clutch 34 is ON. Other gears 8 constantly rotate synchronizing plate 33 at 25% of camshaft 1 speed. The synchronizing plate 33 bears three equispaced linear bearings 39 carrying dowel pins 40. Dowel pins 40 join inner ring 35 and outer ring 50 on opposite sides of the synchronizing plate 33. The outer face of the outer ring 50 has four cams 43 at the same pitch circle radius as a spring loaded pawl 51 held on gear 8 which is mounted on the mode camshaft 2.

When the mode camshaft 2 goes slower than the synchronizing plate 33 as when clutch is not energized, the spring loaded pawl 51 relieves with every incidence against the cams 43. However, when the mode camshaft goes faster than the synchronizing plate 33, as when the clutch is ON, the spring loaded pawl pushes both rings against pressure of spring 44 through the cams 43, over 9 degrees of every 90 degrees of relative rotary displacement of the mode camshaft 2 with respect to the synchronizing plate 33. The resulting movement of the inner ring 35 causes movement of the mode change enabling rod 45 within linear bearing 38 to its unlocked position. In all other conditions, mode change enabling rod 45 is pushed by spring 44 to its locked position in which retraction of any locking levers 18 from their locked positions is made impossible, which disallows change of modes.

When the mode camshaft 2 runs at 102% of speed of synchronizing plate 33, it causes an incremental relative slip of 2%, or 7.2 degrees, for the synchronizing plate 33 with each of its rotation or four camshaft rotations. For 9 degrees of relative slip corresponding to 1.25 mode camshaft 2 rotations or 5 camshaft 1 rotations, a change of mode is enabled by movement of the mode change enabling rod 45. Within this period, the camshaft 1 slips behind the mode camshaft 2 by 36 degrees, which is the upper limit of possible misalignment between the shiftable rotary dispositions of the shifter 12 and the inoperative positions of the corresponding valve cam. To tolerate such an offset, the shiftable rotary positions of each shifter 12 in this embodiment are limited to 51 degrees of mode camshaft 2 rotation corresponding to (240−51=) 204 degrees of camshaft 1 rotation for which the valves 9, 10 are inactive irrespective of the amount of offset. An incremental slip of 90 degrees causes the camshaft 1 to slip by one complete rotation from its starting position. The cams 43 are located with a spacing of 90 degrees, and each of the cams 43 produces a range of rotary positions of the mode camshaft 2 in which there is relative synchronization between the camshaft 1 and mode camshaft 2 enabling change of modes.

For operating the clutch 34 in the middle positions of the activating camshaft 29, a piston of a valve moves with the activating camshaft 29 allowing lubrication oil to pass to the clutch 34 only in the middle positions. In other positions, the oil is returned to the sump by pressure of the clutch springs. The mode camshaft 2 rotates through activation of clutch 34. In near synchronous positions of mode camshaft 2 and camshaft 1, the unlocked mode change enabling rod 45 enables change of modes of individual cylinders as in earlier embodiments. In either of stable mode conditions, the mode camshaft 2 ceases its rotation. The selected modes of each cylinder are maintained until the next operation of the clutch 34.

Other Embodiments of the Invention

Figure 8:
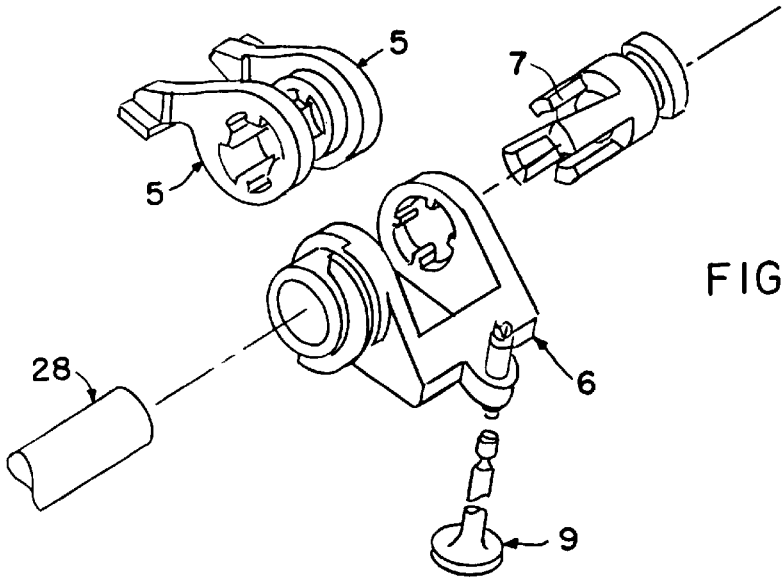
FIG. 8 shows a fifth embodiment with alternately selective valve operation with two valve cams on the camshaft in two active modes.

In a fifth embodiment of the invention, the cylinder valve 9, 10 is alternately operable by two different valve cams on the camshaft 1 in two different active modes, as seen in FIG. 8. The two valve cams have different profiles and/or timings. The modified rocker assembly 5, 6, 7 has two rockers 5 on rocker pivot 28 and one rocking lever 6. The rocker lock has two pairs of fingers with opposite wedge slopes, each pair operating one of each of rockers 5. In either end axial position of the rocker lock 7, one each of the rockers 5 is made operative by the rocker lock 7 for operating the valve 9, 10.

Figure 9:
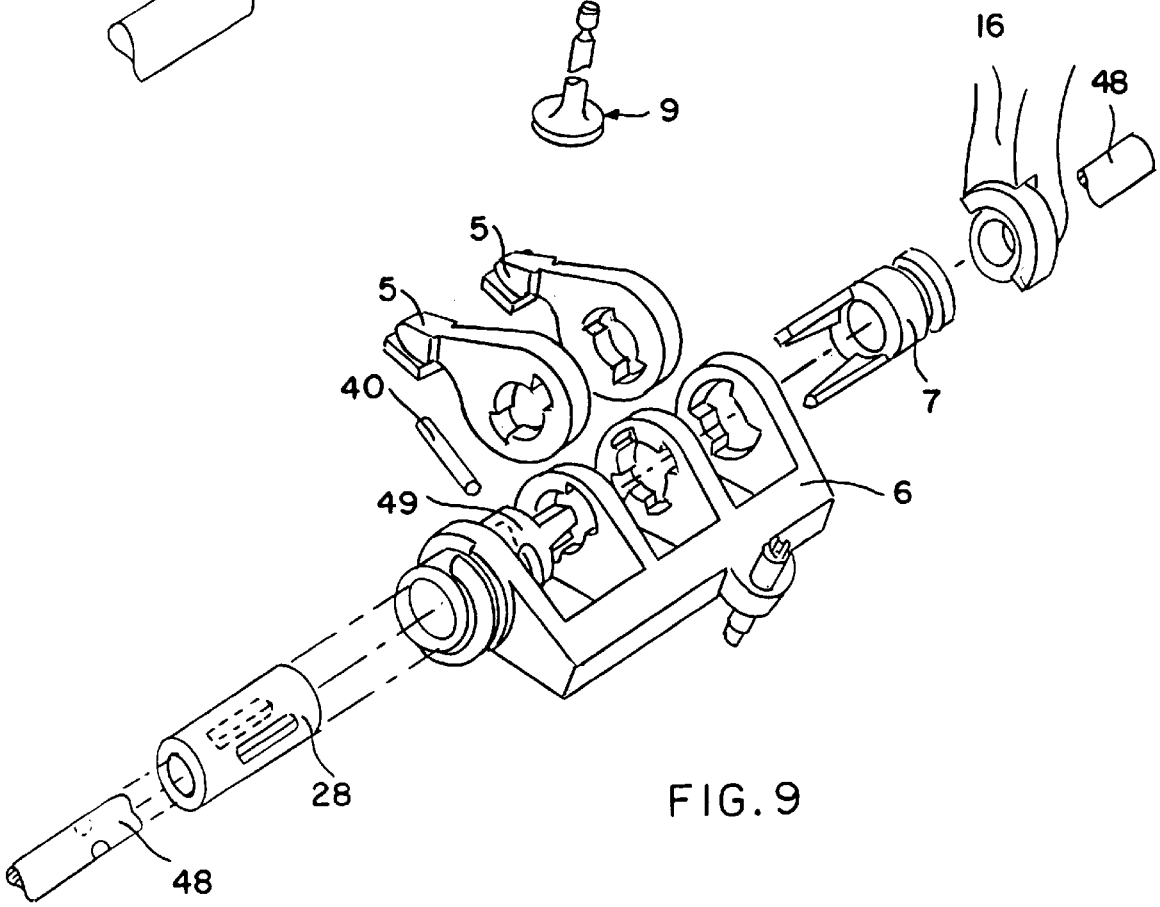
FIG. 9 shows a sixth embodiment with independently selective valve operation in two active modes besides a passive mode.

A sixth embodiment of the invention 15 shown in FIG. 9, and has separate rocker locks 7, 49 for independently selecting valve operations from either of two rockers 5, besides providing the passive mode. The practical application of this embodiment is to provide dynamic braking to an engine when the additional cams on the camshaft 1 open the suction valves in every downward stroke and the exhaust valves at the end of every upstroke, without admission of fuel. The engine compresses air in every two strokes, which provides braking action on the crankshaft. The brake rocker lock 49 is movable by a braking rod 48 slidable within the tubular pivot 22. Inward movement of the braking rod 48, restricted by external means to occur only in the passive mode of the first valve cam, causes higher wedge thickness between the additional rocker 5 and the rocking lever 6, and the valve 9, 10 becomes operable by the additional valve cam on the camshaft 1 which provides dynamic braking. In retracted positions of the braking rod 48, the valve 9, 10 is inoperative in the cycle as in the passive mode of the earlier embodiments.

In another embodiment of the present invention, the engine speed is maintained above the idling speed by keeping one or more cylinders in the active mode whenever the engine speed drops below 120% of this speed. The engine runs idly with the chosen cylinders in the passive mode. The activating camshaft 29 is movable by the accelerator 15, this movement being able to be overridden to some extent by a speed sensing actuator mechanism becoming operational at low speeds. With the limited movement in the latter case, one of the cylinders changes to the active mode.

For embodiments with fuel injected mode selective engines, the injection of fuel is stopped for the passive cylinders. A solenoid operated bypass valve (not shown) returns the fuel to a sump in case the cylinder is passive in the cycle.

In another embodiment involving a throttle free engine, power output is controlled by adjusting the number of active cylinders in each engine cycle. Such an engine has no need for sophisticated devices such as a carburetor for proportionally mixing air and fuel, or a conventional fuel injector for varying the amount of injected fuel in every engine cycle. Instead, a much simpler fixed stroke piston pump delivers a fixed quantity of fuel in the manifold for every active engine cycle.

In other embodiments of the present invention, the shifter 12 has non-rotary periodic movements linked to rotary camshaft 1 movements. As long as the shifter 12 passes through distinct switchable and shiftable positions successively in every cycle, all benefits of the invention can be realized. Electronically controlled embodiments of the invention can have "virtual" shifters, as equivalent timing and powering functions of the mode camshaft 2 are realized with electronic devices and actuators.

What is claimed is:

1. A mode selective intemal combustion engine comprising:

at least one cylinder valve movable on an engine body;

a valve closer;

a camshaft having at least one valve cam for operating a valve opener in active rotary positions;

at least one shifter connected to the camshaft via a relational coupler, said coupler cyclically moving the shifter through positions comprising distinct shiftable and switchable positions in every cycle;

at least one follower;

at least one engager coupling the follower with the shifter;

a selector for activating the engager within switchable positions of a shifter cycle, the shifter in shiftable positions of said shifter cycle moving said follower by said engager between an active position and a passive position;

at least one of the valve closer and the valve opener enabled in at least one rotary position of the camshaft with active position of the follower being disabled by the follower in passive position.

2. A mode selective internal combustion engine as claimed in claim 1, wherein one of valve closer and valve opener is disabled in all rotary positions of said camshaft in passive position of follower.

3. A mode selective internal combustion engine as claimed in claim 1, wherein cyclic movement of said shifter is a rotational movement.

4. A mode selective internal combustion engine as claimed in claim 3, wherein the shifter has at least one track, with at least three joined segments including:

a partially circular first segment, a generally helical second segment, and an at least partially circular third segment, the switchable positions of the shifter being rotary positions in which the engager is engageable with the at least partially circular segments of the track, said shiftable positions of said shifter being rotary positions in which said engager is engageable with said generally helical segment.

5. A mode selective internal combustion engine as claimed in claim 3, wherein the shifter has at least two tracks and two of said enagagers, a first of the tracks having a right handed helical segment, a first of the engagers moving the follower by a first of the tracks, a second of the tracks having a left handed helical segment, a second of the engagers moving the follower by said second of the tracks, said movements by each engager moving the follower to one each of said active and said passive positions.

6. A mode selective internal combustion engine as claimed in claim 5, further comprising a follower bracket rotatably supported on said follower, each engager comprising a follower pin supported by the follower bracket, each engager engaging with one of the tracks of the shifter synchronously with the other engager disengaging from another track of the shifter.

7. A mode selective internal combustion engine as claimed in claim 1, wherein the rotational movement of said shifter is at an integer fractional speed of said camshaft.

8. A mode selective internal combustion engine as claimed in claim 7, wherein the valve opener is disabled in passive position of said follower, and the relational coupler synchronizes shiftable positions of the shifter with other than active rotary positions of the valve cam.

9. A mode selective internal combustion engine as claimed in claim 8, wherein the valve opener includes:

at least one rocker driven by the at least one valve cam on the camshaft;

a rocking lever connected to the at least one cylinder valve, and a rocker lock connecting to said follower movably disposed between said rocker and said rocking lever, the rocker lock transferring rocker motions to the rocking lever in active position of the follower, and the disabling of said valve opener in passive position of said follower by means for removing a part of said rocker lock from between said rocker and said rocking lever.

10. A mode selective internal combustion engine as claimed in claim 7, wherein the rotational operation of said shifter is between ½ and ⅙ times camshaft speed.

11. A mode selective internal combustion engine as claimed in claim 1, wherein the shifter passes through one contiguous range of switchable positions in every cycle.

12. A mode selective internal combustion engine as claimed in claim 1, wherein the selector for activating the engager includes:

at least one locking cam operable synchronously with the shifter, and at least one locking lever responsive to movement of the locking cam for moving the locking lever out of a locked position in switchable positions of the shifter, said locking lever in locked position for preventing activation of the engager.

13. A mode selective internal combustion engine as claimed in claim 1, wherein the selector for activating the at least one engager comprises:

an activating camshaft independently movable between end positions through middle positions, a toggle lever joining to said engager, at least one mode spring connecting the activating camshaft to the toggle lever, and at least one locking spring exerting a retention force for retaining position of the toggle lever, the selector for moving said activating camshaft, wherein movement of the activating camshaft from either of end positions exerts stress by said mode spring on the toggle lever, the greater magnitude of force by the at least one mode spring on said toggle lever through said activating camshaft than retention force by the at least one locking spring activating said engager.

14. A mode selective internal combustion engine as claimed in claim 1, wherein the valve opener comprises a rocker supported on a floating rocker pivot movably held on the engine body, said rocker driven by the valve cam connectable with said cylinder valve, the follower including separating elements for distancing said floating rocker pivot from at least one of said valve cam and said cylinder valve.

15. A mode selective internal combustion engine as claimed in claim 1 wherein said selector comprises a power controller joined to said activating camshaft, wherein movement of said power controller in one direction decreases power by moving said follower to said passive position, and wherein movement of said power controller in an opposite direction increases power by moving said follower to said active position.

16. A mode selective internal combustion engine as claimed in claim 1, wherein a cylinder of said engine has at least two cylinder valves, including a suction valve and an exhaust valve, each cylinder valve having independent shifters and followers and a selector for synchronously activating r engagers for both followers in common switchable positions of both shifters, preceding independent shiftable positions for either shifter in a cycle.

* * * * *